United States Patent [19]

Suzuki et al.

[11] Patent Number: 4,605,359

[45] Date of Patent: Aug. 12, 1986

[54] RADIAL PLUNGER PUMP

[75] Inventors: Masahiko Suzuki; Masatoshi Koroyanagi; Kouichi Moriguchi; Kazuma Matsui, all of Aichi, Japan

[73] Assignee: Nippondenso Co., Ltd., Kariya, Japan

[21] Appl. No.: 706,930

[22] Filed: Feb. 28, 1985

[30] Foreign Application Priority Data

Feb. 28, 1984 [JP] Japan ..... 59-38364

[51] Int. Cl.[4] ..... F04B 27/04; F04B 49/06

[52] U.S. Cl. ..... 417/270; 417/273; 417/286; 91/497

[58] Field of Search ..... 60/421, 422, 428, 429; 91/514–516, 532, 536, 491, 497; 137/118; 417/270, 273, 286, 302

[56] References Cited

U.S. PATENT DOCUMENTS

| | | | |
|---|---|---|---|
| 2,164,888 | 7/1939 | Sassea et al. | 91/487 |
| 2,971,523 | 2/1961 | Dudley | 137/118 |
| 3,279,558 | 10/1966 | Allen et al. | 60/422 |
| 3,355,994 | 12/1967 | Malott | 60/430 |
| 3,596,569 | 8/1971 | Wisbey | 91/503 |
| 3,808,951 | 5/1974 | Martin | 91/497 |
| 3,868,821 | 5/1975 | Ratliff et al. | 60/421 |
| 3,892,167 | 7/1975 | Becker | 91/497 |

FOREIGN PATENT DOCUMENTS

| | | | |
|---|---|---|---|
| 48207 | 7/1982 | Japan | 91/503 |
| 59-711 | 1/1984 | Japan . | |
| 1399596 | 7/1975 | United Kingdom | 91/491 |

*Primary Examiner*—William L. Freeh

*Attorney, Agent, or Firm*—Cushman, Darby & Cushman

[57] ABSTRACT

A radial plunger pump is provided for supplying pressurized working fluid to any of a plurality of systems using a simple construction in which the pump housing is provided with a plurality of outlets and a switching device for switchingly supplying pressurized working fluid to the respective systems without a requirement for a pressurized reservoir for the pump.

8 Claims, 10 Drawing Figures

RADIAL PLUNGER PUMP

FIELD OF THE INVENTION

The present invention relates to a radial plunger pump which may be used as a pump for the engine oil, brake fluid or power steering fluid of an automotive vehicle.

BACKGROUND OF THE INVENTION

Conventionally automobiles are provided with one or more hydraulic fluid powered systems, e.g. for circulating engine oil for lubrication and cooling, pressurized fluid-operated brakes, and pressurized fluid-operated steering systems. In many instances, each such system is provided with its own pump, which is arranged to be operated from power supplied by the automotive engine. Where a plurality of such pumps is provided, sometimes two or more are powered by the same drive shaft, by being mounted to that shaft or by being arranged to be pulley-driven therefrom.

It is also known to use a single pump to supply pressurized working fluid to a plurality of automotive systems. Such a pump is provided with a reservoir and a switching device. Oil, or equivalent working fluid is pressurized in the reservoir by the pump, and the reservoir outlet means is switchably communicated by the switching device to the fluid power-applying lines communicated to the various fluid power-operated systems. Such a single pump/multiple power-operated system arrangement can be quite complex.

SUMMARY OF THE INVENTION

A radial plunger pump is provided for supplying pressurized working fluid to any of a plurality of systems using a simple construction in which the pump housing is provided with a plurality of outlets and a switching device for switchingly supplying pressurized working fluid to the respective systems without a requirement for a pressurized reservoir for the pump.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
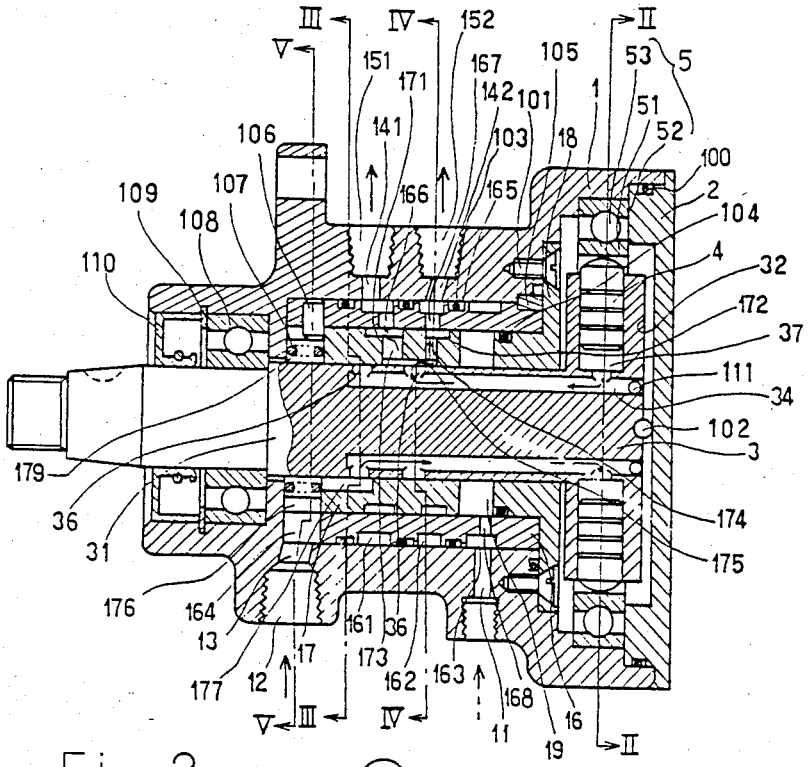
FIG. 1 is a longitudinal cross-sectional view of a radial plunger pump embodying principles of the present invention.

A radial plunger pump embodying principles of the present invention is illustrated in FIG. 1 of the drawing, in which numeral 1 designates the housing of that pump. The housing 1 is shown being provided in the form of a stepped-diameter tubular casing having one end closed by an end plate 2, a circumferential seal at the juncture being provided by a sealing ring such as an O-ring 100.

A ring of bolts, not shown may be provided for securing the cover plate 2 in place on the end of the housing casing 1, the elements 1, 100, 2 thus providing an outer shell for the pump.

The housing casing 1 is shown being provided with a suction port 13 through which the engine oil, brake fluid, power steering fluid, hydraulic oil or other working fluid is communicated through the outer shell of the pump, to the fluid pressurizing means of the pump. A band of internal threading 12 is shown provided where this port emerges to the exterior of the housing, so that a respective conduit may be secured to the housing to serve the port 13.

The casing 1 is shown further provided with a control port 11 for introducing a control fluid for actuating the switching valve 17 (hereinafter described). Control port 11 also is shown provided with a band of conduit-connection threading. Diametrically opposite the ports 13 and 11, the casing 1 is shown provided with discharge ports 141 and 142, respectively provided with bands of conduit-connection threading 151 and 152.

Internally, the casing 1 is shown having an axially extensive central portion of constant diameter, an end portion (at the right in FIG. 1), which increases in diameter in several incremental steps, and an opposite end portion (at the left in FIG. 1), which first abruptly decreases in diameter to provide an annular shoulder and then steps back out to nearly as large a diameter as the central portion to provide space for shaft bearing and seal elements (hereinafter described).

The ports 13, 11, 141 and 152 all communicate to the interior of the casing in the central portion.

Shown coaxially received within the casing is a control sleeve 16 which is cylindrically tubular, axially coterminous with the central portion of the casing 1 and having its radially outer peripheral surface in confronting relation with the radially inner peripheral surface of the central portion of the casing 1.

Shown coaxially received within the control sleeve 16 is the tubular switching valve 17, and, axially gapped from the switching valve 17 at 19, the tubular portion of a sleeve bearing 18. This portion is telescopically located within the control sleeve 16 through one end of the control sleeve and a radially outwardly extending flange at one end extends axially and radially past the one end of the control sleeve 16 where it is secured to the casing by a ring of axially directed, angularly spaced screws 101. The switching valve 17 is biased to the right by a coaxially arranged compression spring 107 which acts against the annular shoulder of the left end portion of the casing 1.

The radial plunger pump further includes a rotor 3 including a shaft 31 which is shown integrally formed with a substantially coaxially circumferential enlargement at one end thereof providing a rotor body 32 thereby arranged for rotation with the shaft 31.

The rotor 3 is coaxially received in the casing 1 so that the shaft 31 projects axially through the tubular portion of bearing 18, through the switching valve 17 and out of the opposite end of the casing 1, and the rotor body 32 is received in the enlarged one end portion of the housing, axially adjacent the end plate 2.

Figure 2:
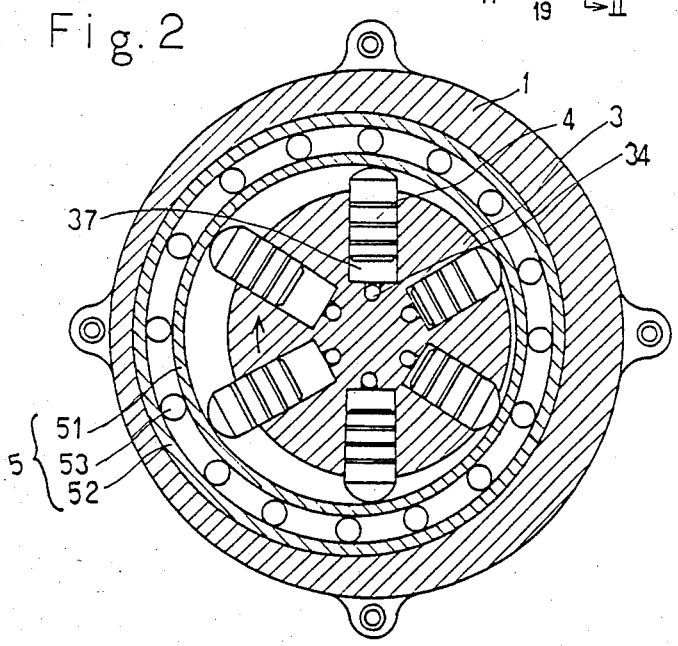
FIGS. 2, 3, 4 and 5, respectively, are transverse cross-sectional views of the pump of FIG. 1, on lines 2—2, 3—3, 4—4 and 5—5 of FIG. 1.

As can be seen from FIG. 2, the enlarged one end portion of the cavity of the housing, where the rotor body 32 is received is of circular transverse cross-sectional figure, but its longitudinal axis is somewhat laterally offset from that of the remainder of the pump, so that as the rotor 3 is rotated, each site on the radially outer periphery of the rotor body 32 is cyclically rotated into and out of adjacency with the radially inner peripheral surface of the enlarged end portion of the casing.

The rotor body 32 is also shown provided with a plurality of equiangularly spaced, radially directed, radially outwardly opening sockets having equal depths and diameters. A free piston-like plunger 4 is slidingly received in each of the sockets in the rotor body, each plunger 4 being provided with a series of circumferential grooves for receiving seal ring means for sealed, sliding engagement with the inner peripheral sidewall surface of the respective socket. Each plunger 4 is sufficiently long, radially of the rotor body 32, that when that plunger is bottomed in its socket, its rounded nose portion still protrudes slightly beyond the radially outer peripheral surface of the rotor body (as shown at the right in FIG. 2).

The rotor 3 is shown journalled for rotation in the housing by a first ball bearing assembly 5 provided between the noses of the plungers 4 and the radially inner peripheral of the enlarged end portion of the casing 1, a thrust ball bearing provided between an axially central detent provided on the one end of the rotor, and the axially inner surface of the housing end plate 2, and a second ball bearing assembly 108 provided between the rotor shaft 31, axially beyond the annular shoulder of the opposite end portion of the casing 1.

A split ring retainer 109 received in a circumferentially extending internal groove in the opposite end portion of the casing holds the bearing 108 in place against the annular shoulder. Axially beyond that, an annular oil seal 110 is shown provided in the end of the casing 1 to prevent oil leakage where the shaft 31 emerges from the housing.

The ball bearing assembly 5 in the one end portion of the casing 1 is shown having its outer race 52 engaged between a step shoulder on the casing and an annular boss on the axially inner face of the housing end plate 2. This outer race 52 also has its radially outer peripheral surface engaged with the radially inner peripheral surface of a corresponding step of the casing 1. The inner race 51 of the bearing 5 circumscribingly engages the noses of the plungers 4, the bearing 5 further including a set of bearing balls 53 rollingly entrapped between the races 51 and 52. Accordingly, the plungers 4 are constructed and arranged to be cammed to their depth in their respective sockets, by engagement with the inner race 51 of the bearing 5, and also to be constrained against expulsion from their respective sockets by such engagement. During each rotation of the rotor, each plunger 4 thus is once gradually pushed radially inwardly of the rotor body 32 to its maximum depth in its respective socket (shown at the right in FIG. 2), and once gradually permitted to maximally project from its respective socket (shown at the left in FIG. 2), correspondingly cyclically decreasing and increasing the volume of each chamber 37 formed in the rotor body 32 between the respective plungers 4 and the inner ends of the respective sockets. The inner race 51 tends to rotate with the rotor 3.

The tubular portion of the bearing 18 serves as a sleeve bearing for the rotor shaft 31.

In use, a sprocket or pulley (not shown) is mounted on the protruding end of the shaft 31. The casing 1 is fixedly mounted and conduits are fitted to the respective ports. The shaft pulley or the like receives rotary power from the automotive engine or the like (not shown), by means of an endless drive belt or the like (not shown), entrained about both the pulley or the like and a similar element (not shown) mounted on an output shaft (not shown) of the automotive engine or the like. The cyclical effect of rotating the rotor 3 is to cyclically increase and decrease the volumes of the chambers 37 in a phased manner, due to the equiangular spacing of the plungers 4 about the rotor body 32.

Figure 3:
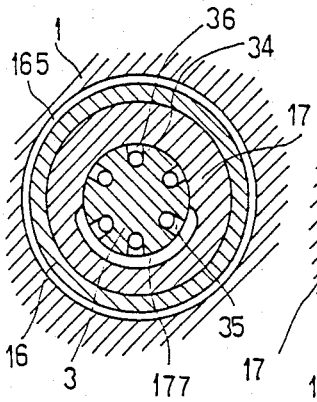
Figure 4:
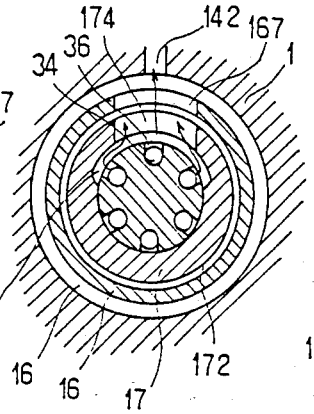
Figure 6:
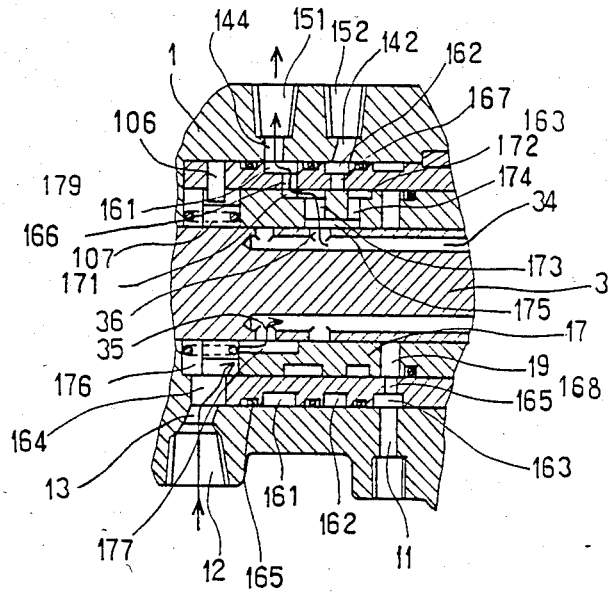
FIGS. 6 and 7 are enlarged scale fragmentary longitudinal sectional views of the pump of FIG. 1 at respectively different moments in a cycle of operation thereof.

Each chamber 37 is shown connected through the inner end of the respective socket with a respective passageway 34 which then proceeds longitudinally within the rotor 3. If the passageways are formed by drilling in through the right end of the rotor, the end openings are sealed closed, e.g. using plugs 111. Three of these passageways 34, e.g. those serving the three lowermost plunger chambers of FIG. 2, are open at 35 to the exterior of the rotor shaft 31 intermediate the length thereof at a site which permits them to periodically communicate with a suction groove 177 formed in the radially inner peripheral surface of the switching valve 17. The angular extent of the suction groove 177 is shown in FIG. 3, and the axial extent thereof is shown in FIGS. 1 and 6. The other three of these passageways 34, e.g. those serving the three uppermost plunger chambers of FIG. 2, are open at 36 to the exterior of the rotor shaft 31 intermediate the length thereof at a site which permits them to periodically communicate with a discharge notch 175 also formed in the radially inner periphery of the switching valve 17. The angular extent of the discharge notch 175 is shown in FIG. 4, and the axial extent thereof is shown in FIGS. 1 and 6.

The tubular control sleeve 16 is shown provided at three axially spaced intermediate locations in its radially outer peripheral surface with respective circumferentially extending, radially outwardly opening grooves 161, 162, 163. Smaller circumferential grooves 165 shown placed to the left of each of the respective grooves 161, 162 and 163 receive 0-rings which seal between the control sleeve 16 and corresponding circumferential sites on the radially inner peripheral surface of the central portion of the casing 1.

Figure 5:
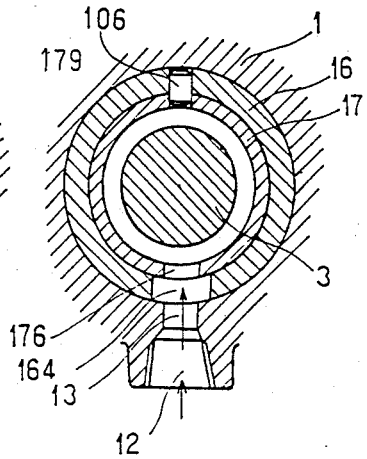

The groove 161 is arranged for communication with the first discharge port 141; the groove 162 is arranged for communication with the second discharge port 142; and the groove 163 is arranged for communication with the control port 11. A passageway 164 formed completely through the thickness of the control sleeve 16 near its left end (as shown at the lower left in FIG. 1 and the bottom in FIG. 5) is arranged for communication with the suction portion 13.

The grooves 161, 162 and 163 are separately communicated radially inwardly through the thickness of the control sleeve 16 with the radially inner peripheral surface thereof by passageways 166, 167 and 168, respectively.

A radially directed pin 106 is shown fixed in a corresponding bore in the control sleeve 16 and projecting radially inwardly therefrom (near the left end thereof as shown at the top left in FIG. 1) somewhat beyond the radially inner peripheral surface of the control sleeve 106 into a longitudinal slot 179 in the switching valve left end so as to provide a positive stop limiting axially rightward movement of the switching valve 17 by engagement with the right end of slot 179 of the switching valve, and to prevent angular rotation of the control sleeve 16 and switching valve 17 relating to one another.

The tubular portion of bearing 18 is provided in its radially outer peripheral surface adjacent the circumferential gap 19 between the left end of the bearing 18 and the right end of the switching valve 17, with a radially outwardly opening circumferential groove 181 which receives an 0-ring 104 for sealing between the tubular portion of the sleeve bearing 18 and a corresponding circumferential site on the radially inner peripheral surface of the control sleeve 16.

The tubular switching valve 17 is shown provided on the radially outer peripheral surface thereof with two axially spaced, circumferentially extending, radially outwardly opening grooves 171 and 172. Each is communicated radially through the thickness of the switching valve 17, at a respective site, to the radially inner peripheral surface of the switching valve, by a respective passageway 173 and 174. On the radially inner peripheral surface of the switching valve 17, the passageways 173 and 174 are shown interconnected by a longitudinally extending radially inwardly opening notch 175.

Diametrically opposite the slot 179 for the pin 106, the switching valve 17 is shown provided with a radially extending passageway 176 which communicates the radially inwardly opening circumferential groove in which the compression spring 107 is received, to the radially outer peripheral surface of the switching valve 17, and thus being arranged to communicate the suction groove 177 of the switching valve 17, through the passageway 164 of the control sleeve 16, with the suction port 13 of the casing 1.

The gap 19 between the left end of the tubular portion of the bearing 18 and the right end of the switching valve 17, also bounded by the radially outer peripheral surface of the rotor shaft 31 and the radially inner peripheral surface of the control sleeve 16, provides a pressure control chamber served by the pressure control port 11 of the casing 1 via the passageway 168 and groove 163.

An effect of increasing control pressure communicated to the chamber 19 through the port 11 is to force the switching valve 17 as shown in FIG. 1, to correspondingly slide axially to the left, causing the spring 107 to become correspondingly compressed. An effect of decreasing control pressure communicated to the chamber 19 through the port 11 is to allow the compressed spring 107 to correspondingly recover by returning the switching valve 17 as shown in FIG. 1 correspondingly to the right.

As the shaft 31 is rotated, with the plunger chambers 37 of the three lower plungers 4 communicated via the suction port 11 to a conduit containing the fluid such as oil that is to be pumped, centrifugal forces on those plungers as the lower half of the rotor body 32 (FIG. 2) rotates to the left, causes the plungers to slide outwards, successively increasing the volumes of the three respective cavities, thereby lowering the pressure therein and sucking oil in through the suction port 11 to successively fill the three respective chambers 37, finally successively insulating each from the oil supply as the openings 35 of the corresponding passageways 34 are successively isolated by passing the end of the suction groove 177.

The function of the switching valve 17 is to regulate whether the pressurized working fluid discharged from the pump will flow out of both of the discharge ports 141 and 142, or only out of one of them.

If the control pressure applied at 11, e.g. using a controllably-pressurized oil system (not shown) is relatively high, the switching valve 17 is maintained in its leftmost position as shown in FIG. 1 and the three upper chambers 37 which are being successively progressively forcibly reduced in volume are communicated via the respective passageways 34, openings 36 and notch 175 to both the discharge port 141 and the discharge port 142, by way of passageways 173 and 174, grooves 171 and 172, passageways 166 and 167 and grooves 161 and 162.

The relative positions and extents of the various openings, ports, passageways and grooves which have been described are such that, as the control pressure applied at 11 is decreased to an intermediate level, the spring 107 forces the switching valve 17 axially rightwards to an intermediate location as shown in FIG. 6, in which the switching valve 17 progressively communicates the three upper chambers 37 which are being reduced in volume, with the discharge port 141, but isolates them from the discharge port 142, by closing-off communication with the discharge groove 162.

Figure 7:
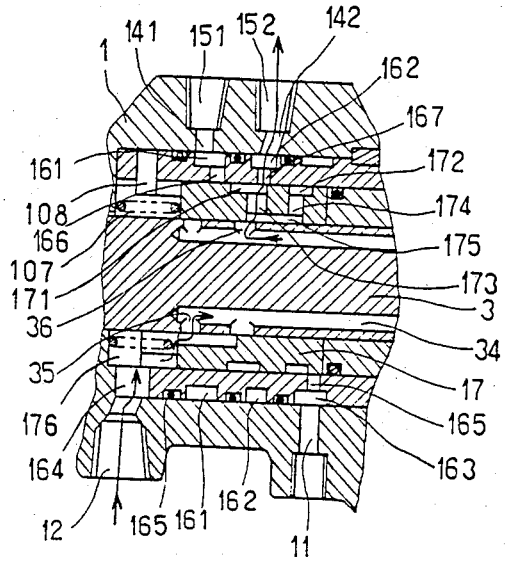

And as the control pressure applied at 11 is further decreased to an even lower level, or cut off, the spring 107 forces the switching valve 17 axially further rightwards to a location as shown in FIG. 7, in which the switching valve progressively communicates the three upper chambers 37 which are being reduced in volume, with the discharge port 142, but isolates them from the discharge port 141, by closing-off communication with the discharge groove 161.

Whereas the pressurized fluid for pressurizing the control chamber may be supplied from a separate pressure source, not shown, as an alternative it may be constituted by the working fluid being pumped by the radial plunger pump of the present invention. For instance, a control fluid conduit (not shown) may be provided connecting the discharge port 142 with the control port 11. In such an instance, when the switching valve is on the rightward, FIG. 7 position thereof, working fluid discharged under pressure at 152 as the rotor 3 rotates is communicated via the port 11 to the control chamber 19 as control fluid. This pressurized control fluid, acting on the right end of the switching valve 17 forcibly slides the switching valve 17 leftwards. As the switching valve 17 is thus moved to its FIG. 6 position so that the working fluid being discharged becomes split between the two discharge ports 141, 142, the pressure in the line (not shown) connecting the discharge port 142 with the control port 11 drops to a lower level, therefore decreasing the pressure in the control chamber 19, permitting the compressed spring 107 to return the switching valve 17 towards the right, to its FIG. 7 position.

Although the radial plunger pump of the invention has been described as having two discharge ports, 141 and 142, it is within the scope of the invention to similarly provide a larger plurality, e.g. three, four or more discharge ports, depending on the number of systems to be served, by correspondingly modifying the numbers and positions of discharge ports, the control sleeve 16 and the switching valve 17.

With suitable modification, the switching valve 17 could be caused to select among opening either discharge port 141 or 151, or opening both discharge port 141 and discharge port 142 by rotating clockwise and/or counterclockwise, angularly of its own longitudinal axis, rather than by reversibly sliding axially without rotating, as has been shown and described hereinabove. Such a modification would necessitate modifications to the shapes and positions of the passageways and grooves of the control sleeve 16 and the switching valve 17 in ways which should now be apparent.

Figure 8:
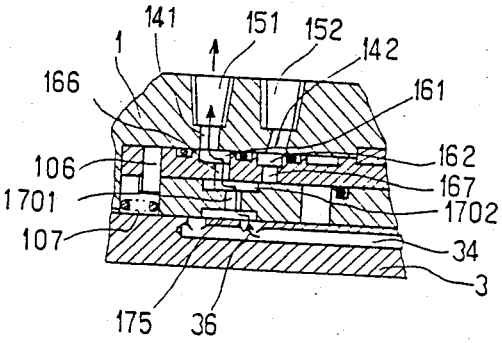
FIGS. 8, 9 and 10 are fragmentary longitudinal sectional views similar to FIGS. 6 and 7, but of a second embodiment of the pump.
Figure 9:
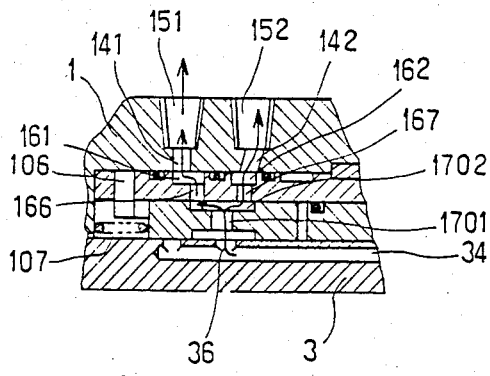
Figure 10:
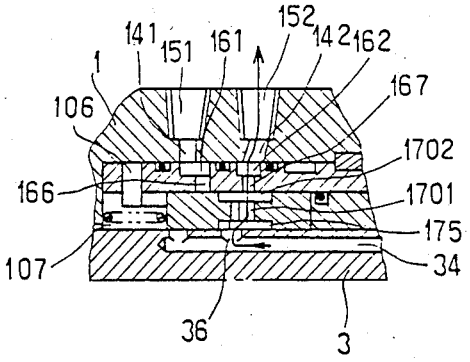

In the second embodiment of the radial plunger pump, which is shown in FIGS. 8–10, the switching valve is modified to have one common passageway 1701 and one discharge groove 1702 in place of the elements 171–174 of the first embodiment. The length of the groove 1702, longitudinally of the switching valve, is relatively greater than the distance between the axially outer ends of the grooves 171 and 172 of the first embodiment, to such an extent that, when correspondingly aligned, the groove 1702 communicates simulatenously with both of the passageways 166 and 167, as shown in FIG. 9. Therefore, the radial plunger pump equipped with the modified switching valve of FIGS. 8–10 can deliver pressurized working fluid out of both discharge ports 141, 142, when positioned as shown in FIG. 9, or only out of the discharge port 141, when positioned as shown in FIG. 8, or only out of the discharge port 142, when positioned as shown in FIG. 10.

It should now be apparent that the radial plunger pump as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

We claim:

1. A radial plunger pump, comprising:

a housing;

a rotor including a shaft having a substantially coaxially circumferential enlargement providing a body thereon arranged for rotation therewith;

means defining a plurality of angularly spaced, radially aligned, radially outwardly opening cylinder cavities in said rotor body;

a respective piston-like plunger sealingly, slidingly received in each said cylinder cavity and being constructed and arranged for reciprocating movement radially of said rotor body upon rotation of said rotor thereby to increase and decrease the volume of a respective chamber defined in the respective said cavity, radially inwardly of an axially inner end of such plunger;

means defining a cavity in said housing including a first portion which is constructed and arranged to enclose said rotor body and an adjoining second portion which is constructed and arranged to enclose a portion of said shaft;

said rotor body and shaft portion being received in said first and second portions of said housing cavity, means journalling said rotor with respect to said housing for rotation about the longitudinal axis of said rotor; with a portion of said shaft being accessible for application of rotary power thereto for rotating said rotor about said axis;

said first portion of said housing cavity having inner peripheral wall means including, cam surface means which are curved about to form an endless path that is eccentric with respect to said rotor body;

said plungers being constructed and arranged to ride in centrifugally-urged contact with said cam surface means as said rotor is rotated, thereby oscillating each plunger in the respective said cylinder/-cavity and correspondingly cyclically increasing and decreasing the volume of the respective said chamber formed in such cylinder cavity;

means defining a respective fluid passageway communicated with each said cylinder cavity chamber and extending within said rotor body and said shaft to at least one site located intermediate the longitudinal extent of such shaft, at which at least one site each such fluid passageway emerges from said shaft;

means defining at least one fluid suction port through said housing to said housing cavity;

means defining at least two fluid discharge ports through said housing from said housing cavity;

a switching valve received within and movably mounted on said housing as a tubular member coaxially received radially between said shaft and said housing;

said switching valve including suction passageway means constructed for periodically connecting a continually changing at least one but less than all of said fluid passageways of said rotor to said at least one fluid suction port of said housing and these only during a predetermined portion of each cycle of rotation of said rotor while each corresponding cylinder cavity chamber is increasing in volume;

said switching valve further including discharge passageway means constructed and arranged for periodically connecting a continually changing at least one but less than all of said fluid passageways of said rotor to a selectable at least one of said at least two fluid discharge ports of said housing and these only during a predetermined portion of each cycle of rotation of said rotor while each corresponding cylinder cavity chamber is decreasing in volume;

said switching valve being constructed and arranged for movement between at least two positions in at least one of which said discharge passageway means connect the respective said at least one fluid passsageway of said rotor with at least one different one of said at least two fluid discharge ports of said housing than it does when positioned in at least another of said at least two positions.

2. The radial plunger pump of claim 1, wherein:

further including means mounting said switching valve in said housing for axial movement between said at least two positions thereof.

3. The radial plunger pump of claim 2, further comprising:

means including an end of said switching valve forming a fluid pressuizable control chamber within said housing;

means defining a control port through said housing into communication with said fluid pressurizable control chamber, such control port and control chamber being so constructed and arranged that pressurized fluid admitted to said chamber through said control port acts on said end to slide said switching valve in a first axial direction; and return means operatively associated with said fluid pressurizable control chamber, such return means and switching valve being constructed and arranged to slide said switching valve in an axially opposite direction upon decreaing of pressure in said control chamber.

4. The radial plunger pump of claim 3, wherein:

said return means comprises a compression spring acting between said housing and an opposite end of said switching valve.

5. The radial plunger pump of claim 3, further including:

a fluid conduit operatively connecting one of said discharge ports from said housing with said control port for supplying pressurized fluid to said control chamber.

6. The switching valve of claim 3, wherein:

said switching valve is constructed and arranged to be axially moved to three positions thereof, in a first of which one of said at least two fluid discharge ports of said housing is connected with the respective said at least one passageway of said rotor but not with at least another of said at least two fluid discharge ports of said housing, in a second of which said one fluid discharge port is isolated from the respective said at least one passageway of said rotor but said other fluid discharge port is connected with the respective said at least one passageway of said rotor, and in the third of which both said one and said other fluid discharge ports are connected with the respective said at least one passageway of said rotor.

7. The switching valve of claim 6, wherein:

said first position is located axially intermediate said second and third positions.

8. The switching valve of claim 7, wherein:

said third position is located axially intermediate said first and second positions.

* * * * *